US008006958B2

(12) United States Patent
Starks et al.

(10) Patent No.: US 8,006,958 B2
(45) Date of Patent: Aug. 30, 2011

(54) BATTERY POWERED WINCH

(75) Inventors: Shelby K. Starks, Baltimore, MD (US); David A. Carrier, Aberdeen, MD (US); Daniel J. White, Baltimore, MD (US); Daniel N. Lopano, Towson, MD (US); James B. Watson, Fallston, MD (US); Lauren M. Wenchel, Bel Air, MD (US); David A. Goldman, Phoenix, MD (US); Maurice L. LaPointe, Ellicott City, MD (US); Daniele C. Brotto, Baltimore, MD (US); Gabriel E. Concari, Eldersburg, MD (US); William J. Robinson, Ellicott City, MD (US)

(73) Assignee: Black & Decker Inc., Newark, DE (US)

( * ) Notice: Subject to any disclaimer, the term of this patent is extended or adjusted under 35 U.S.C. 154(b) by 183 days.

(21) Appl. No.: 11/985,573

(22) Filed: Nov. 15, 2007

(65) Prior Publication Data

US 2008/0224110 A1 Sep. 18, 2008

Related U.S. Application Data

(60) Provisional application No. 60/859,294, filed on Nov. 15, 2006.

(51) Int. Cl.
*B66D 1/00* (2006.01)

(52) U.S. Cl. ..... 254/323

(58) Field of Classification Search ..... 254/264, 254/265, 346, 378, 323
See application file for complete search history.

(56) References Cited

U.S. PATENT DOCUMENTS

| | | | | | |
|---|---|---|---|---|---|
| 3,757,194 | A | | 9/1973 | Weber et al. | |
| 4,033,552 | A | * | 7/1977 | Kuzarov | 254/342 |
| 4,145,028 | A | * | 3/1979 | Kelley et al. | 254/346 |
| 4,588,167 | A | * | 5/1986 | Finzel | 254/346 |
| 4,623,124 | A | * | 11/1986 | Lewis | 254/350 |
| 4,884,784 | A | * | 12/1989 | Nix et al. | 254/362 |
| 4,984,955 | A | | 1/1991 | McCullough | |
| 5,002,259 | A | * | 3/1991 | Manning et al. | 254/350 |
| 5,214,359 | A | | 5/1993 | Herndon et al. | |
| 5,474,278 | A | * | 12/1995 | Cleveland | 254/334 |
| 5,522,582 | A | * | 6/1996 | Dilks | 254/323 |
| 5,560,441 | A | | 10/1996 | Moody et al. | |
| 5,573,091 | A | * | 11/1996 | Hung | 192/12 R |
| 5,607,143 | A | * | 3/1997 | Regal | 254/342 |
| 5,678,982 | A | * | 10/1997 | Schwaiger | 417/44.2 |
| 5,842,684 | A | | 12/1998 | Aho | |

(Continued)

OTHER PUBLICATIONS

Warn Works, Advertisement, PullzAll Hand-Held Electric Pulling Tool, http://warn.com/works/pullzall/tools; Nov. 7, 2007; 1 page.

*Primary Examiner* — Emmanuel M Marcelo
(74) *Attorney, Agent, or Firm* — Adan Ayala

(57) ABSTRACT

A portable winch assembly includes a winch mechanism connected to a support structure adapted to be manually transportable. A battery pack is releasably coupled to a remote control unit. The remote control unit is operated to control the winch mechanism. The battery pack and the remote control unit can be electrically connected to the winch mechanism by a flexible power cable, or the battery pack can be mounted with the winch mechanism and a wireless remote control unit can be used to operate the winch mechanism.

24 Claims, 16 Drawing Sheets

U.S. PATENT DOCUMENTS 6,241,215 B1 * 6/2001 Gersemsky et al. ..... 254/342
6,334,269 B1 1/2002 Dilks
6,354,682 B1 * 3/2002 Nott et al. ..... 312/248
6,516,478 B2 * 2/2003 Cook et al. ..... 5/611
6,523,806 B2 * 2/2003 Bartal ..... 254/323
6,572,082 B1 * 6/2003 Dixon et al. ..... 254/323
6,694,545 B1 2/2004 Renton
6,864,650 B2 3/2005 Heravi et al.
6,966,544 B2 * 11/2005 McCormick et al. ..... 254/342
6,995,682 B1 * 2/2006 Chen et al. ..... 340/825.72
7,059,803 B2 6/2006 Floe et al.
7,226,041 B2 6/2007 Ledford
7,261,277 B2 8/2007 Copeman
D556,420 S * 11/2007 Trihey et al. ..... D34/33
7,311,297 B1 * 12/2007 Bradshaw et al. ..... 254/272
D571,973 S * 6/2008 Burns et al. ..... D34/33
D573,775 S * 7/2008 Burns et al. ..... D34/33
7,458,563 B1 * 12/2008 Liu ..... 254/334
7,484,714 B1 * 2/2009 Tsai ..... 254/343
7,543,798 B2 * 6/2009 Cunningham ..... 254/266
2001/0040233 A1 * 11/2001 Chamberlain ..... 254/4 R
2005/0077878 A1 4/2005 Carrier et al.
2006/0096771 A1 5/2006 Brotto
2006/0201980 A1 * 9/2006 Koons ..... 224/511
2008/0023681 A1 * 1/2008 Cunningham ..... 254/362
2008/0128668 A1 * 6/2008 Fofonoff et al. ..... 254/334
2008/0149425 A1 * 6/2008 Lucy ..... 187/217
2008/0246011 A1 * 10/2008 Heravi et al. ..... 254/266

* cited by examiner

BATTERY POWERED WINCH

CROSS-REFERENCE TO RELATED APPLICATIONS

This application claims the benefit of U.S. Provisional Application No. 60/859,294, filed on Nov. 15, 2006. The disclosure of the above application is incorporated herein by reference.

FIELD

The present disclosure relates generally to winches and, more particularly, to a winch assembly having a removable and rechargeable battery pack.

BACKGROUND

Portable winches are generally known in the art. In many instances, portable winches are configured with a cord for plugging into a nearby conventional 120 volt AC outlet. In other instances, portable winches are configured to be powered by one or more car batteries (i.e., lead-acid 12 volt batteries). Unfortunately, these types of batteries are relatively heavy and thus not particularly suitable for portable applications. Moreover, these types of batteries may not provide the higher voltages needed to achieve the line pull capacity of most winches. In addition, the batteries are not integral with the winch assembly. Therefore, it is desirable to provide a portable winch assembly having a lightweight, removable and rechargeable battery pack.

The statements in this section merely provide background information related to the present disclosure and may not constitute prior art.

SUMMARY

According to several embodiments of the present disclosure, a portable winch assembly includes a winch mechanism. A battery pack is releasably coupled to a remote control unit. The remote control unit is remotely located from the winch mechanism and is operated to control the winch mechanism.

According to further embodiments, a portable winch assembly includes a winch mechanism connected to a support structure adapted to be manually transportable. A battery pack is releasably coupled to a remote control unit. The remote control unit is operated to control the winch mechanism. The battery pack and the remote control unit can be electrically connected to the winch mechanism by a flexible power cable According to still further embodiments, a portable winch assembly includes a winch mechanism connected to a support structure adapted to be manually transportable. A battery pack releasably coupled to a remote control unit is operated to control the winch mechanism. A retractable strap housing connected to the support structure includes a flexible strap manually extendable from the strap housing and automatically retractable into the housing.

According to other embodiments, a portable winch assembly includes a winch mechanism connected to a support structure adapted to be manually transportable. The winch mechanism includes a spool having a wire releasably wound thereon and a lift connector attached to a free end of the wire. A battery pack positioned remote from the winch mechanism provides electrical power to the winch mechanism to rotate the spool to release or retract the wire. A device connected to the support structure operates to electrically isolate the winch mechanism when the lift connector contacts the support structure.

According to still other embodiments, the battery pack is releasably coupled to the support structure and is operable to provide electrical power to the winch mechanism. A wireless remote control unit is operated to remotely control the winch mechanism.

According to still other embodiments, a method for controlling a portable winch mechanism having a support structure using a battery pack and a remote control unit is provided.

DRAWINGS

The drawings described herein are for illustration purposes only and are not intended to limit the scope of the present disclosure in any way.

DETAILED DESCRIPTION

Figure 1:
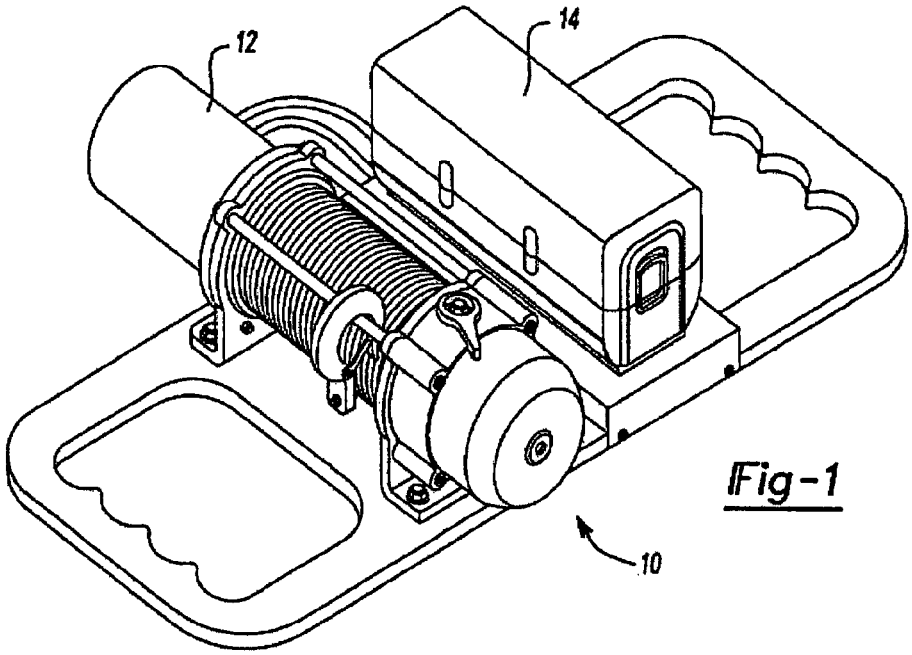
FIG. 1 is a perspective view of any exemplary portable winch assembly having a removable and rechargeable battery pack.
Figure 2:
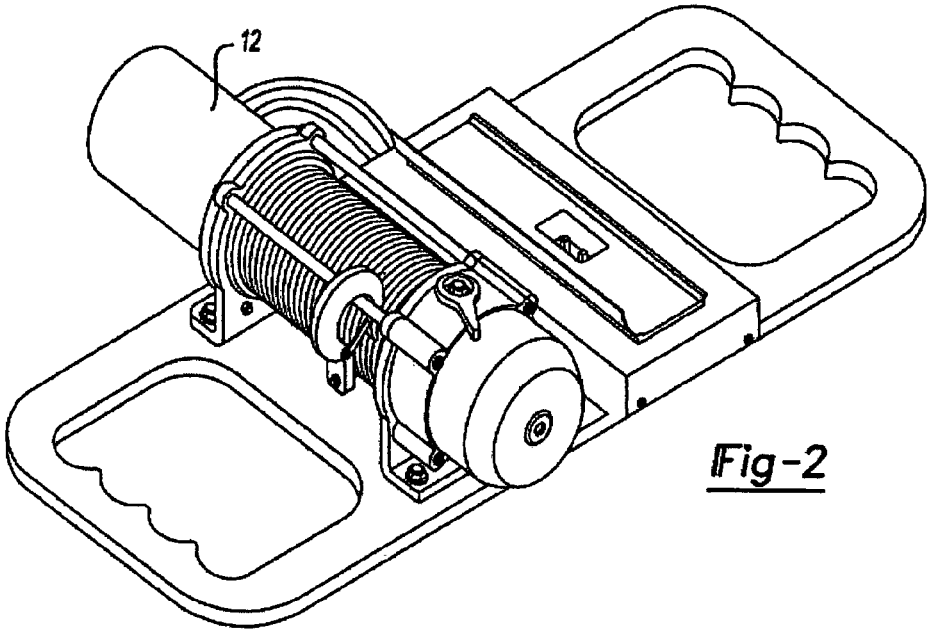
FIG. 2 is a perspective view of the exemplary portable winch assembly with the battery removed from the assembly.

FIGS. 1 and 2 illustrate an exemplary portable winch assembly 10. The winch assembly 10 is generally comprised of a winch mechanism 12 and a removable and rechargeable battery pack 14 mounted on a common mounting plate 16. The winch mechanism is further defined as a spool for winding a cable and a drive mechanism, such as an electric motor, for rotating the spool. The winch mechanism is preferably lightweight and exhibits a compact dimensional design. An exemplary winch mechanism is the 1.5 ci winch commercially available from Warn Industries. It is readily understood that other winch mechanisms are also within the scope of this disclosure.

The drive mechanism for the winch is powered by a removable battery pack. The battery pack is preferably a rechargeable high power battery pack, such as Li-ion or other high power source. In one exemplary embodiment, the cells of the battery pack may be Li-ion having one or more of a lithium metal oxide cell chemistry, a lithium-ion phosphate (LPF) cell chemistry and/or another lithium-based chemistry makeup, for example, in terms of the active components in the positive electrode (cathode) material. As examples, the active material in the cathode of the cell with a metal oxide chemistry may be one of lithiated cobalt oxide, lithiated nickel oxide, lithiated manganese oxide spinel, and mixtures of the same or other lithiated metal oxides. The active component in the cathode of a cell having LPF chemistry is lithiated metal phosphate, as another example. The material of the negative electrode may be a graphite carbon material on a copper collector or other known anode material as is known in Li-ion batteries. It is contemplated that cells having other chemistry, such as nickel cadium (NiCd) or nickel metal hydride (NiMH), are also within the scope of this disclosure.

Figures 3A, 3B:
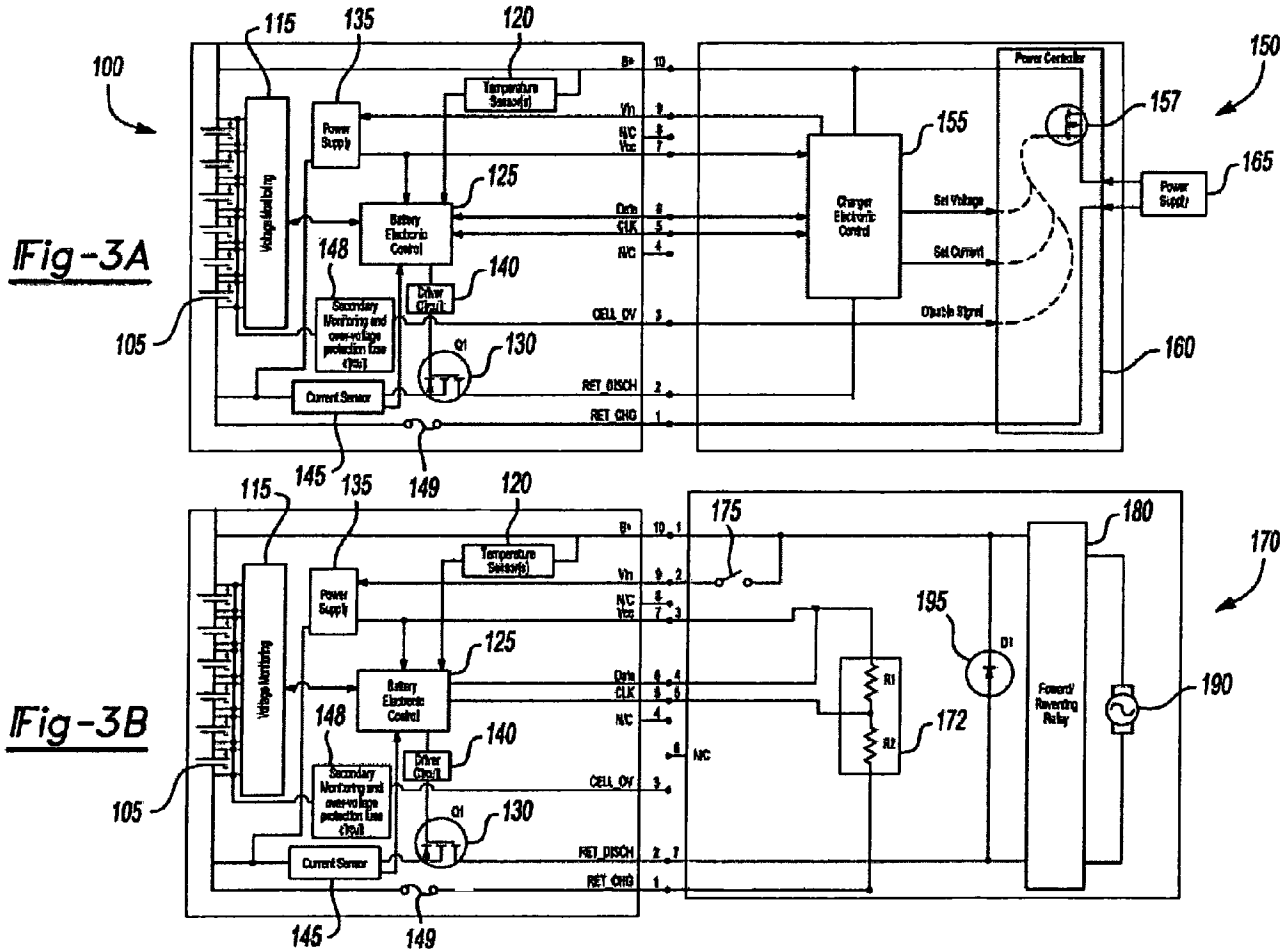
FIG. 3A is a block diagram illustrating internal electronic components and connections between an exemplary battery pack and an exemplary battery charger.
FIG. 3B is a block diagram illustrating internal electronic components and connection between the exemplary battery pack and an exemplary winch mechanism.

FIG. 3A is a block diagram illustrating internal electronic components and connections between an example battery pack and an example battery charger. Battery pack 100 may include a plurality of battery cells 105 connected in series (six shown for simplicity, pack 100 could include more or less than six cells or may be composed of serial strings of cells with the serial strings in parallel with each other). For purposes of describing the example embodiments. Battery pack 100 may be composed of cells with a lithium-ion cell chemistry. As the example embodiments are directed to a portable winch assembly which requires much higher voltage ratings than conventional devices using Li-ion battery technology, the nominal voltage rating of the battery pack 100 may be at least 18V.

Pack 100 may be understood as a removable power source for high-power, power tool operations. In an example, battery pack 100 may have a nominal voltage rating of at least 18 volts and/or have a maximum power output of at least about 385 Watts. However, it should be evident to those skilled in the art that the disclosure is not necessarily limited to the specific voltage ratings and/or power output specifications described above. Battery pack 100 may further be composed of cells of another lithium-based chemistry, such as lithium metal or lithium polymer, or other chemistry such as nickel cadmium (NiCd), nickel metal hydride (NiMH) and lead-acid, for example, in terms of the chemistry makeup of individual cells, electrodes and electrolyte of the pack 100.

In FIG. 3A, ten terminal connections (terminals 1-10) are shown. However, the example embodiments should not be limited to this terminal configuration, as more or less terminals could be included depending on the desired information passed between, or parameters monitored by, the battery pack 100 or charger 150.

A battery electronic control unit 125 may be responsible for the protection of the cells 105 for any fault condition exposed on the terminals by the user (via charger 150, an attached tool, and/or due to user tampering). The battery electronic control unit 125 may be powered by an internal power supply 135 as shown. The battery electronic control unit 125 may be embodied in hardware or software as a digital microcontroller, a microprocessor or an analog circuit, a digital signal processor or by one or more digital ICs such as application specific integrated circuits (ASICs), for example. The battery electronic control unit 125 may include various types of memory that may execute one or more software or firmware programs. Example memory may include RAM, FLASH and EEPROM. As an example, RAM may be used to store program variables during run time. As an example, FLASH memory may be used to store program code and calibration values. EEPROM may also be provided to store calibration values, data logging information, error codes, etc.

The discharge current may be clamped or discontinued by the use of semiconductor device 130 (discharge FET) under the control of battery electronic control unit 125. The battery electronic control unit 125 may be powered by an internal power supply 135 as shown, and may control the ON/OFF state of discharge FET 130 through a driver circuit 140.

The charging of battery cells 105 may be controlled by the battery electronic control unit 125 communicating over data lines to the charger 150. By containing the charge FET 157 within the charger 150 instead off within pack 100, both space and power dissipation (heat) may be moved from the compact battery pack 100 to the charger 150.

Battery pack 100 may further include a current sensor 145 which senses current and provides a signal to battery electronic control unit 125. Current sensor 145 may be embodied by known components for current sensors, such as a shunt resistor, current transformer, etc. which may provide a signal representing sensed current in pack 100 to battery electronic control unit 125.

Battery pack 100 may also include voltage monitoring circuitry or arrangement 115. An example voltage monitoring arrangement 115 is described in detail in co-pending and commonly assigned U.S. patent application Ser. No. 11/239,286 to Carrier et al., filed Sep. 30, 2005 and entitled "METHOD AND DEVICE FOR MONITORING BATTERY CELLS OF A BATTERY PACK AND METHOD AND ARRANGEMENT FOR BALANCING BATTERY CELL VOLTAGES DURING CHARGE, (hereafter the '286 application) the entire contents of which are hereby incorporated by reference. The voltage monitoring arrangement 115 may be configured to sense individual cell voltage and sense total pack voltage of the string of cells 105 ('stack voltage') to provide a signal representing the individual cell or stack voltage to battery electronic control unit 125. As described in the '286 application, the voltage monitoring arrangement 115 may be embodied as an integrated circuit to take, singly or sequentially, a sampled reading comprising one of an individual cell voltage or a total stage voltage for all cells in the pack. The sampled reading may be filtered in the integrated circuit prior to being read by the battery electronic control unit 125.

In another example as described in the '286 application, the battery electronic control unit 125 may direct voltage monitoring arrangement 115 to periodically measure, throughout the duration of charging, the cell voltage across each cell of the pack and the total pack voltage in a sequential manner. The measured individual cell voltages and a current average cell voltage for all cells are sent by the voltage monitoring arrangement 115 to the battery electronic control unit 125. The measured total pack voltage is automatically divided by the number of cells within the pack to determine the current average cell voltage. The battery electronic control unit 125 thus may control balancing of each of the cell voltages during the charge based on each measured individual cell voltage and the determined current average cell voltage.

Optionally, the pack 100 may be provided with its own identification (ID), if communicating with another intelligent device such as a charger microprocessor or a tool microprocessor. A pack ID (not shown), if desired, may be embodied by an ID resistor, LED display that displays identification data of the pack, serial identification data sent upon engagement and sensed by the tool/charger via data and clock terminals 5 and 6 for example, and/or a field in a frame of data sent over an air interface to the tool/charger, etc.

Battery pack 100 may further include one or more temperature sensors 120. Temperature sensor 120 may be embodied as NTC or PTC thermistors, Temperature sensing integrated circuits, or thermocouples. The temperature sensor 120 may communicate the temperature inside the battery pack 100 to intelligence in the battery pack 100 and/or to intelligence in a connected charger 150, for example, via terminal 10 to charger electronic control 155. As the function of such temperature sensors are known, a detailed explanation of functional operation is omitted for purposes of brevity.

Battery pack 100 may include auxiliary internal protection circuits or devices including a secondary monitoring and over-voltage protection fuse circuit 148 and a charge fuse 149 in the return charge line from charger 150. As to be described in more detail below, the secondary monitoring and over-voltage protection fuse circuit 148 separately monitors the voltage of each cell (in addition to voltage monitoring arrangement 115) to detect any cell (one or some or all cells) which reaches an over-voltage condition during charge. In such a case, the secondary monitoring and over-voltage protection fuse circuit 148 may send a disable signal directly to the charger 150 to terminate charge current. This provides backup protection in case the cell balancing functionality within the voltage monitoring arrangement 115 becomes corrupted during charge and/or the voltage monitoring arrangement 115 becomes inoperative.

The charge fuse 149 acts as a tertiary protection device to blow in the case that both cell balancing (arrangement 115) and secondary over-voltage protection measures from circuit 148 become inoperative and/or fail to detect a cell over-voltage condition for whatever reason. Once charge fuse 149 blows, charge and discharge is permanently disabled within pack 100.

When battery pack 100 is connected to charger 150, a charger electronic control unit 155 in the charger 150 may be powered from the battery's internal power supply 135 through terminal 9. This is only an example connection scheme, as other means for powering the charger electronic control unit 155 can be employed. The charger 150 could have its own supply or derive it directly from the battery voltage. The charger electronic control unit 155 may also be embodied in hardware or software as a digital microcontroller, microprocessor, analog circuit, digital signal processor, or by one or more digital ICs such as application specific integrated circuits (ASICs), for example. The charger electronic control unit 155 may drive a power controller 160 with a set voltage and a set current to deliver the desired voltage and current from a power source 165 to the battery pack 100 via terminals 1 and 10.

Battery and charger data and control information may be exchanged through serial data paths on terminals 5 and 6. For example, terminals 5 and 6 could be used to provide charger ID data and other information to the battery electronic control unit 125. Such information may include, but is not limited to, the digital ID of the charger, the charger current, total stack voltage of the cells as read by the charger, temperature conditions of the charger, AC mains level of the charger, etc. In an example, any problem the charger 150 senses during its diagnostic testing can be communicated to the battery electronic control unit 125 through serial data paths on terminals 5 and 6. In another example, if the battery electronic control unit 125 receives a charger fault such as low AC mains, the battery electronic control unit 125 can generate an error message to the charger and/or wait before resuming charging, for example. Moreover, based on the information and Charger ID data, the battery electronic control unit 125 can control the charger output and/or control charging decisions for its cells based on the charger data. Commands to the charger then may be issued.

FIG. 3B is a block diagram illustrating components and connections between an example battery pack and the winch mechanism. FIG. 3B is merely an example circuit configuration and is provided as a context for more clearly describing the various protection methods, circuits and devices in accordance with the example embodiments.

In general, during discharge to provide power to the winch motor 190, the battery electronic control unit 125 may output pulse width modulation (PWM) control signals to drive the driver circuit 140. For example, a pulsing semiconductor (pulse width modulator (PWM)) is commonly used in the electronics industry to create an average voltage that is proportional to the duty cycle. PWM is modulation in which the duration of pulses is varied in accordance with some characteristic of the modulating signal. Alternatively, pulse frequency modulation could be used to create this average voltage. In either case, discharge FET 130 may be switched between ON and OFF states to create an average voltage that is proportional to the duty cycle at which it is switched.

During discharge to the winch mechanism 170, the driver circuit 140 level shifts the PWM output of battery electronic control unit 125 to drive the gate of discharge FET 130, cycling discharge FET 130 on and off depending on sensed conditions. The component arrangement that comprises driver circuit 140 is known in the art and is not described herein for reasons of brevity.

FIG. 3B illustrates a standard winch arrangement 170 without an intelligent device such as a tool electronic control, it being understood that pack 100 could communicate with a smart tool having associate tool electronic control via terminals 5 and 6. The winch 170 includes an on/off switch 175 and a motor control switch (not shown). The on/off switch enables the winch 170 to draw power from the battery pack 100. In an exemplary embodiment, the motor control switch interfaces with a forward/reverse relay 180 which is electrically coupled to the motor 190. The motor control switch may be a momentary type switch having three positions for controlling operation of the winch. In a center position, the winch 170 is in an off state. To operate the winch 170, the switch must be actuated to one of the other two positions. In one position, the normally open contact of the relay 180 is closed so that power from the cells 105 flows out of terminal 10 and through the motor 190. In this position, the spool is rotated in a direction that winds the cable. In the other switch position, the relay 180 operates in a similar manner to drive the motor in an opposite direction so that the spool is rotated in a direction that unwinds the cable. When the motor control switch is released by the operator, it returns to the center position, thereby terminating rotation of the spool.

Battery pack 100 may receive tool information from a tool ID 172 within the power tool 170. As shown, tool ID 172 is configured as a voltage divider (R1 and R2) which provides back to the battery electronic control unit 125 a voltage value representing an ID value of the tool that is recognized by the battery electronic control unit 125. Different tools may have a different ID value. The ID value may inform the battery electronic control unit 125 as to the power, voltage and/or current limits of the attached tool, so that the battery electronic control unit 125 may control the output voltage accordingly. If the tool 170 was a smart tool having its own microprocessor, this information could be passed as serial data via terminals 5 and 6 to the battery electronic control unit 125. Further details for an exemplary battery pack 10 may be found in co-pending and commonly assigned U.S. patent application Ser. No. 11/552,832 filed Oct. 25, 2006 and entitled "BATTERY PACK FOR CORDLESS POWER TOOLS the entire contents of which are hereby incorporated by reference.

With continued reference to FIG. 1, the winch mechanism 12 and battery pack 14 are preferably mounted on a support plate 16. The mounting plate may extend on either side beyond the mounted components. A cutout 18 may be formed into an extending portion of the support plate to serve as a handle for transporting the assembly. On the other side, one or more key shaped notches 19 may be formed into the extending portion of the support plate. These notches may be used to secure the assembly during winching operations.

Figure 4:
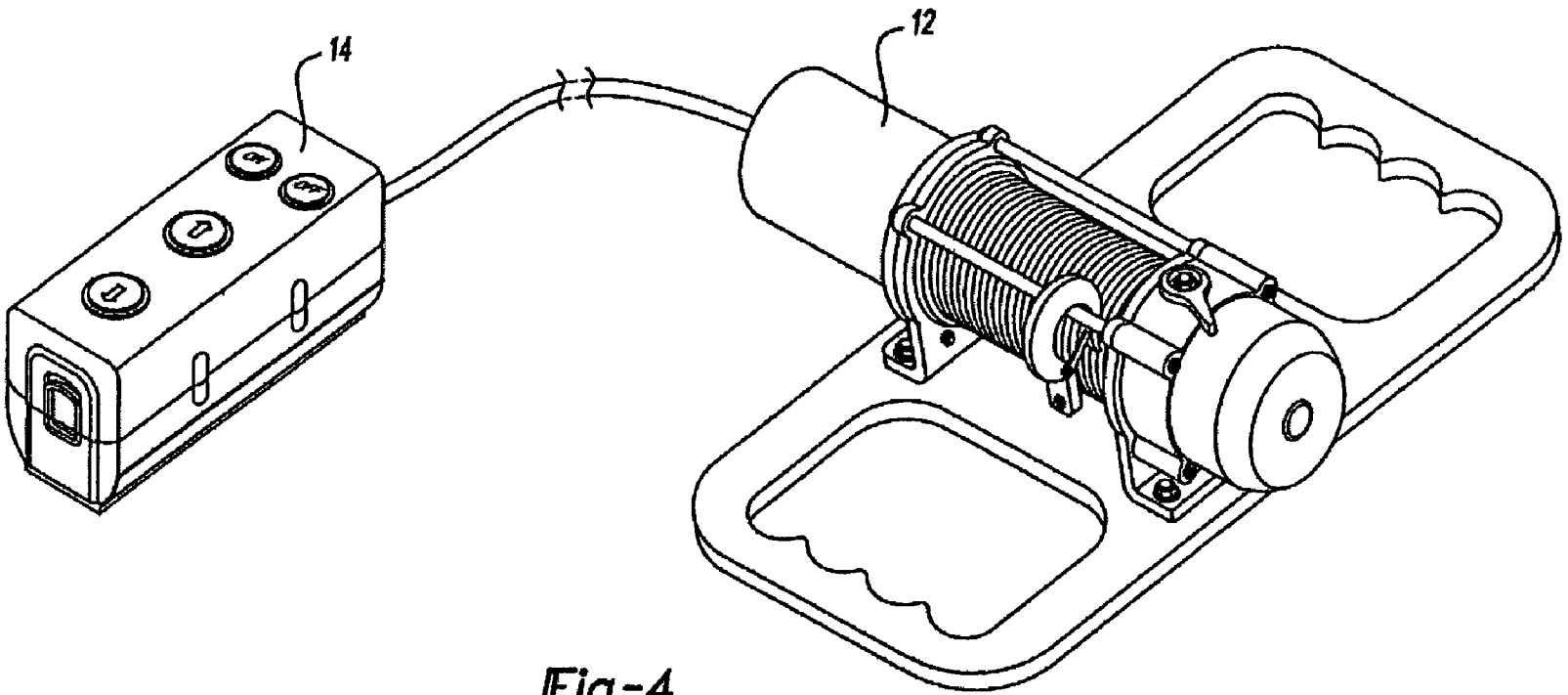
FIG. 4 is a diagram of an alternative embodiment of a portable winch assembly where the battery pack may be separated from the winch mechanism.

In an alternative configuration, the battery pack is separated from the winch mechanism as shown in FIG. 4. In this configuration, the winch mechanism may be mounted on a support plate having the features described above. The battery pack may be positioned at a position physically separated from the winch mechanism. The battery pack is in turn connected via a cable to provide power to the winch mechanism. The battery back may otherwise be configured in the same manner as described above.

Figure 6:
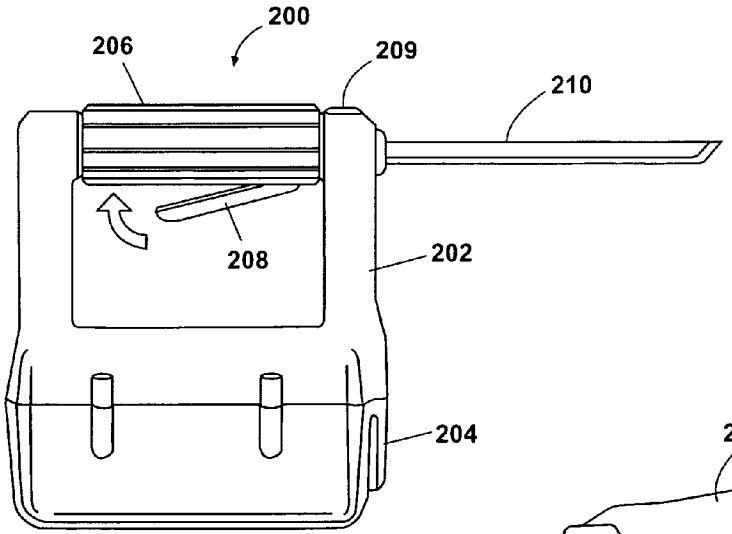
FIG. 6 is a side elevational view of a hand held remote control unit having a releasable, rechargeable battery pack.

Referring to FIG. 6, a hand-held remote control unit 200 for remotely controlling a portable winch assembly of the present disclosure includes a frame 202 adapted to releasably receive a removable battery pack 204. A handle 206 is connected to frame 202 and a lift control switch 208 which functions by manually rotating lift control switch 208 toward handle 206 provides a variable speed control function. A direction control switch 209 can also be connected to frame 202 which permits an operator to choose between a lifting or lowering (infeed and outfeed or retracting and extending) operation for the portable winch assembly. A power cable 210 extends from frame 202 to transfer electrical power from removable battery pack 204 to the winch assembly.

Figure 7:
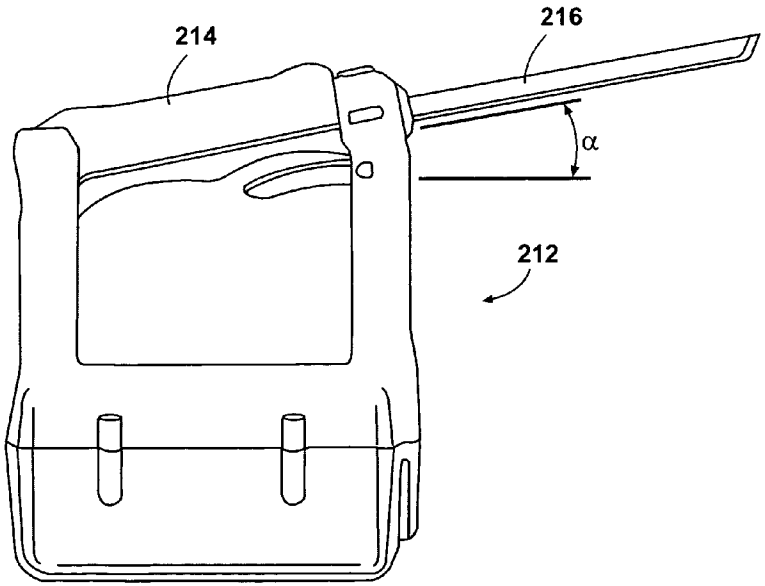
FIG. 7 is a side elevational view of a hand held remote control unit modified from the unit of FIG. 6.

Referring to FIG. 7, a hand held remote control unit 212 is modified from the hand-held remote control unit 200 of FIG. 6 through the use of an ergonomic handle 214 which is oriented at an angle $\alpha$ with respect to the orientation of handle 206 of hand-held remote control unit 200. According to several embodiments angle $\alpha$ can be approximately 10 degrees. It should be understood that angle $\alpha$ can vary below or above 10 degrees at the discretion of the manufacturer. The advantage of providing ergonomic handle 214 oriented at angle $\alpha$ is to orient power cable 216 initially extending from hand-held remote control unit 212 also at angle $\alpha$ to reduce the amount of bending of power cable 216 as the winch assembly changes elevation.

Figure 8:
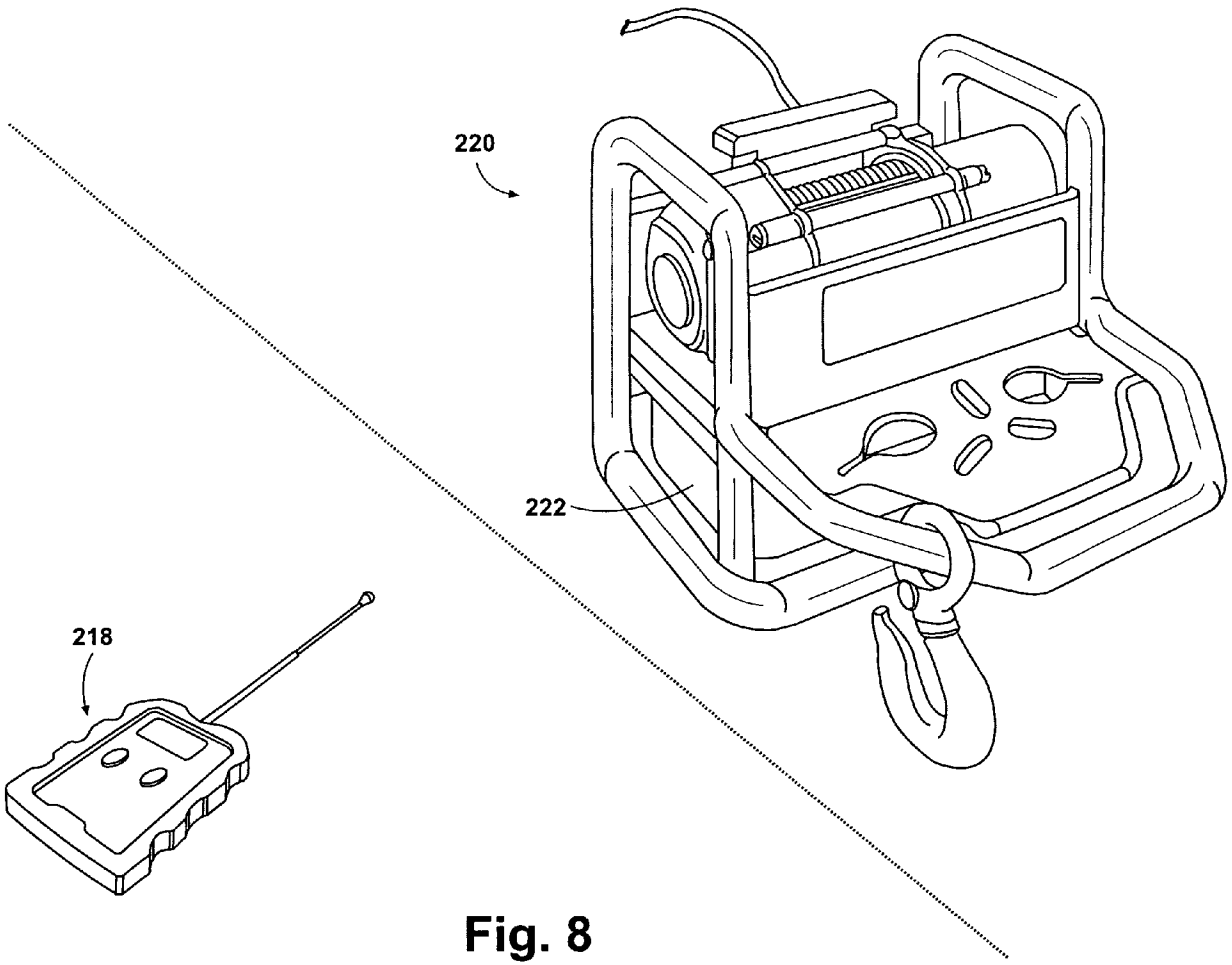
FIG. 8 is a front perspective view of a portable winch assembly controllable by a wireless remote control unit.

Referring to FIG. 8, according to additional embodiments of the present disclosure a wireless remote control unit 218 can also be provided to remotely control operation of a portable winch assembly 220. Portable winch assembly 220 is therefore adapted to receive the electrical signal generated by wireless remote control unit 218 through a receiver (not shown). When the wireless remote control unit 218 is used, a battery pack 222 is installed with the structure of portable winch assembly 220. The one or more replaceable and rechargeable batteries of battery pack 222 are adapted to be removable for recharge and can also be adapted through a remote recharging unit (not shown) so that the batteries of battery pack 222 can be recharged in place.

Figure 10:
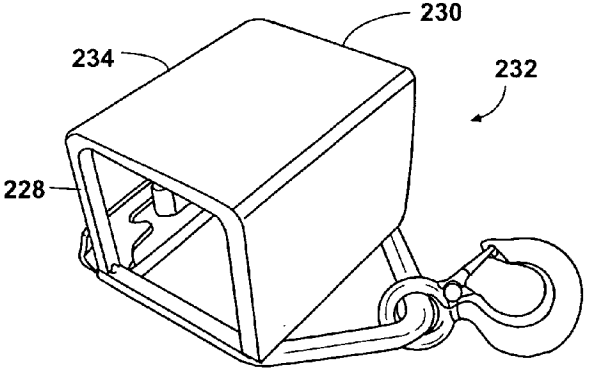
FIG. 10 is a front perspective view of the support frame of FIG. 9 modified to include a protective cover.
Figure 9:
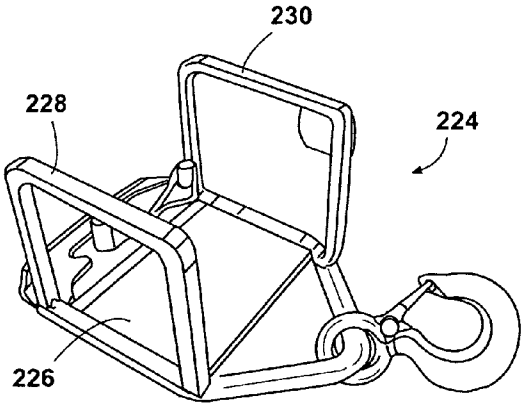
FIG. 9 is a front perspective view of an open support frame for a portable winch assembly of the present disclosure.

Referring now to FIGS. 9-12, several exemplary embodiments of frame structure for supporting a portable winch assembly of the present disclosure are shown. Each of the various embodiments provides structural support and protection for the winch assembly. Referring specifically to FIG. 9, a winch support frame 224 includes a support base 226 adapted to fixedly receive the portable winch assembly (now shown for clarity). Each of a first and an opposed second frame member 228, 230 which are formed in a U-shape of tubular material extend transversely away from support base 226. First and second frame members 228, 230 provide additional protection for the components of the winch assembly such as the motor or battery pack. Referring more specifically now to FIG. 10, winch support frame 224 of FIG. 9 is modified to include a cover 234 which is connected to each of the first and second frame members 228, 230. Cover 234 can be provided of a rigid material such as a metal or a rigid polymeric material. Cover 234 is adapted to connect to two of the three legs of each of first and second frame members 228, 230.

Figure 12:
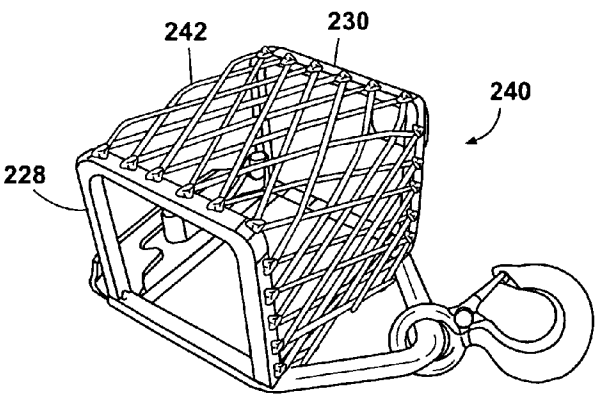
FIG. 12 is a front perspective view of the support frame of FIG. 9 modified to include a mesh protective cover.
Figure 11:
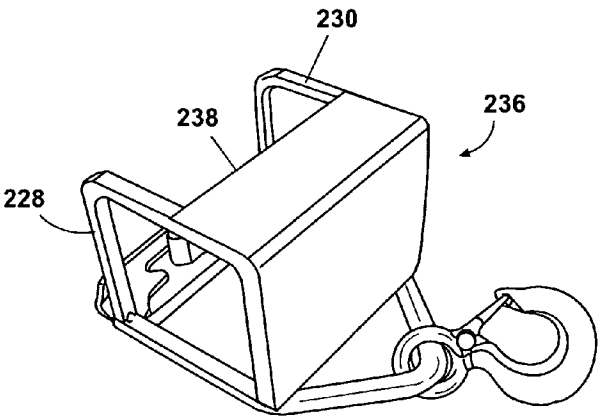
FIG. 11 is a front perspective view of the support frame of FIG. 9 modified to include a partial protective cover.

Referring more specifically to FIG. 11, according to further embodiments the assembly of FIG. 10 is modified to reduce the size and coverage of cover 234 by using a modified spool visibility cover 238. Cover 238 extends for only a portion of the coverage provided by cover 234 in order to provide user visibility to the spool area of the winch assembly from a remote operator location. Referring generally to FIG. 12, a mesh cover 242 is used in place of cover 234 to provide maximum visibility for the components of the winch assembly while simultaneously providing a similar range of protection as provided by cover 234. Mesh cover 242 can further be adapted to be reduced in size similar to cover 238 at the discretion of the manufacturer.

Figure 13:
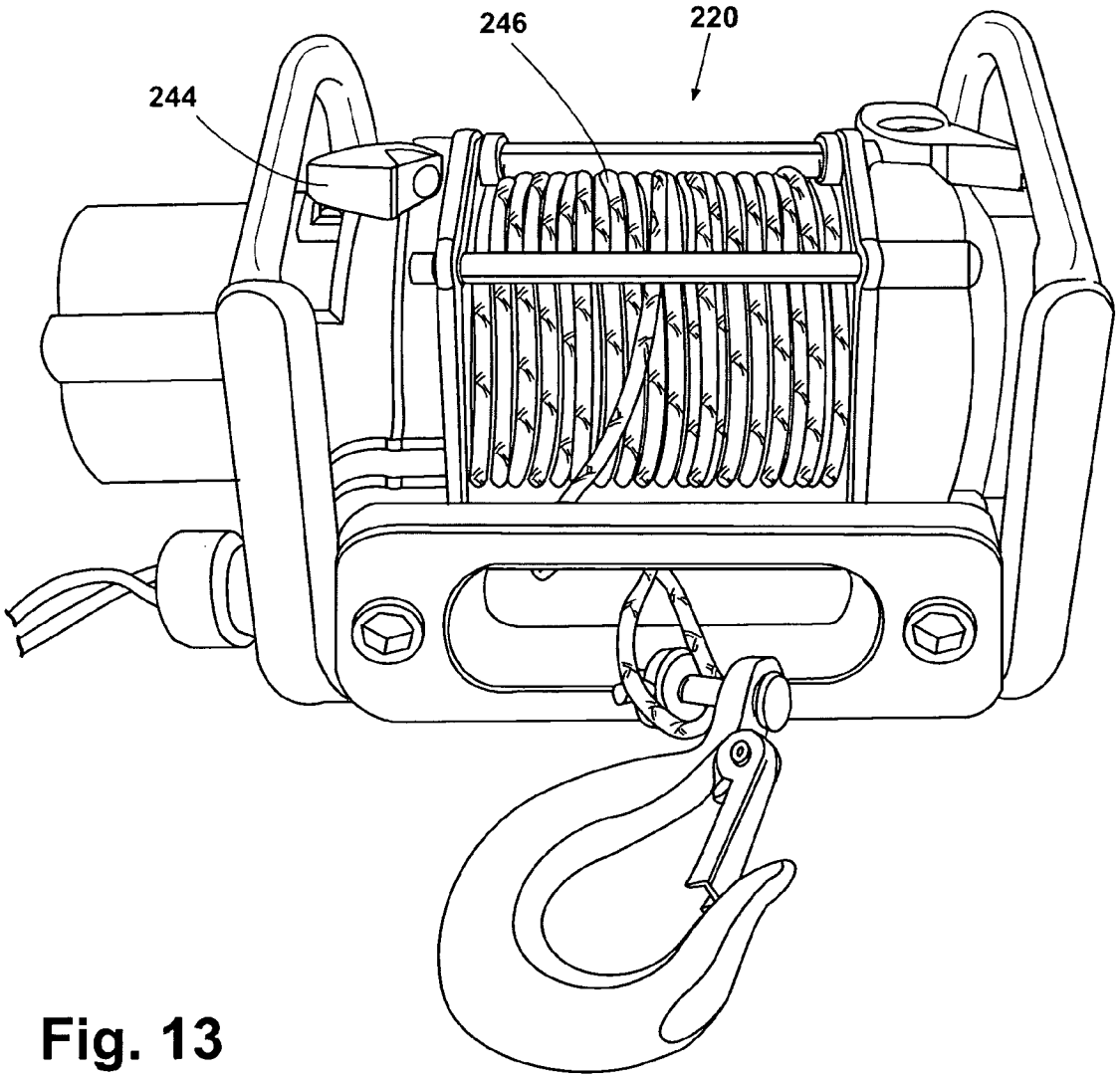
FIG. 13 is a front perspective view of a portable winch assembly having an attached light.

Referring now to FIG. 13, portable winch assembly 220 is further modified to include a light 244 which receives power from either a local or remotely located battery pack (not shown). Light 244 is provided to illuminate the area of a spool 246 to provide remote identification to the user of rotation of the spool 246 and the general winding of the cable provided thereon. Light 244 can be used for example in closed environments such as a garage or similar structure where local lighting proximate to the winch assembly may not be available. Light 244 can be energized whenever the winch assembly is operating, or by operation of a switch provided either on the portable winch assembly 220 or provided with the remote control unit.

Figure 15:
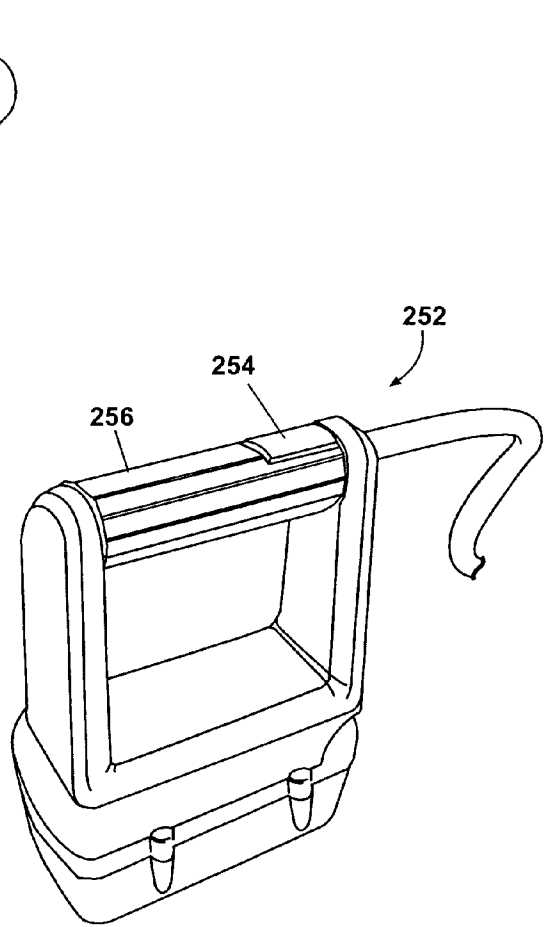
FIG. 15 is a side elevational view of a hand held remote control unit modified from the unit of FIG. 6.
Figure 14:
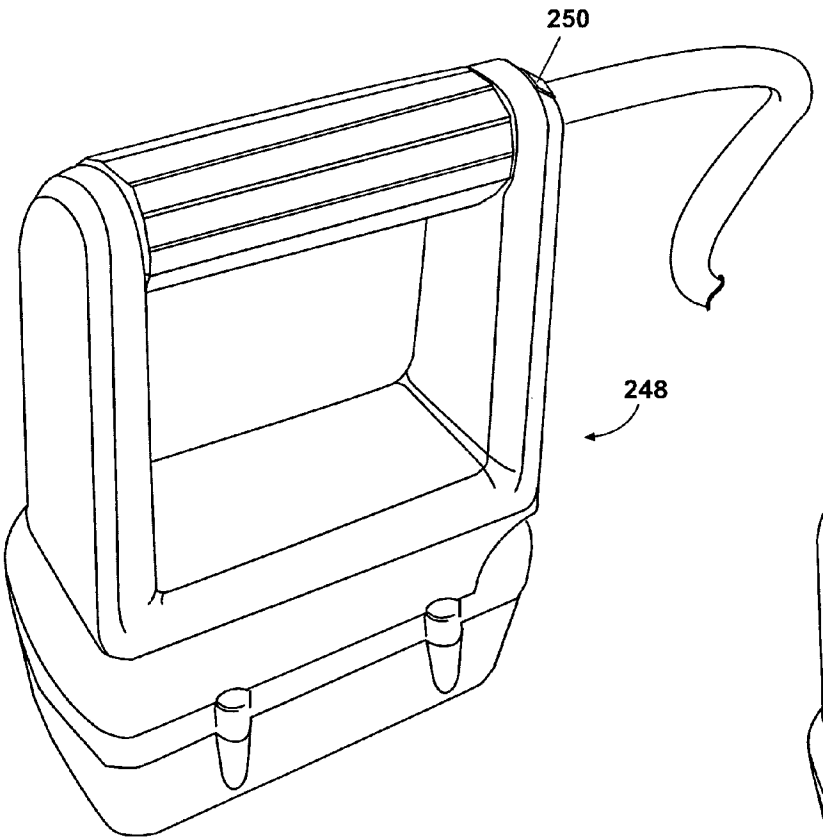
FIG. 14 is a side elevational view of a hand held remote control unit modified from the unit of FIG. 6.

Referring now to both FIGS. 14 and 15, additional embodiments for hand-held remote control units providing alternate switch locations are shown. In FIG. 14, a hand-held remote control unit 248 provides a universal thumb switch 250 which can be used to control both the deployment and retraction of a wire from the winch assembly and the direction of rotation of the spool. Referring specifically to FIG. 15, a hand-held remote control unit 252 includes a sliding switch 254 mounted on a handle 256.

Figure 16:
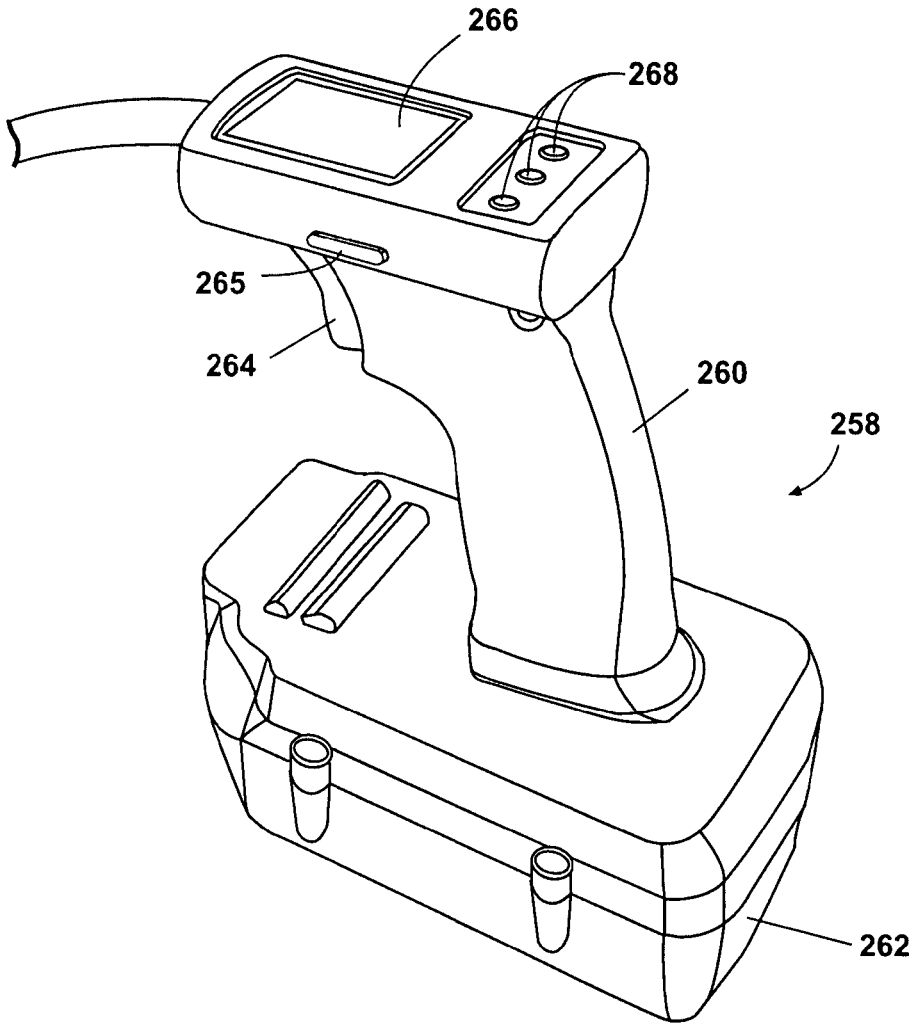
FIG. 16 is a side elevational view of a digital readout hand held remote control unit.

Referring to FIG. 16, a hand-held remote control unit 258 includes a hand-grip portion 260 which is adapted to receive a removable battery pack 262. A multiple finger grip switch 264 is provided with hand-grip portion 260. A direction control switch 265 can also be provided on hand-grip portion 260. Hand-held remote control unit 258 further includes a digital readout 266 which can be adapted to provide a digital visual indication of an operating parameter of the portable winch assembly. This can include indication of a motor/reel torque level used to identify when a maximum operating load is being approached for the portable winch assembly. A plurality of indicator LED's 268 can also be provided. LED's 268 can provide for example a visual indication of the relative charge remaining in removable battery pack 262.

Figure 17:
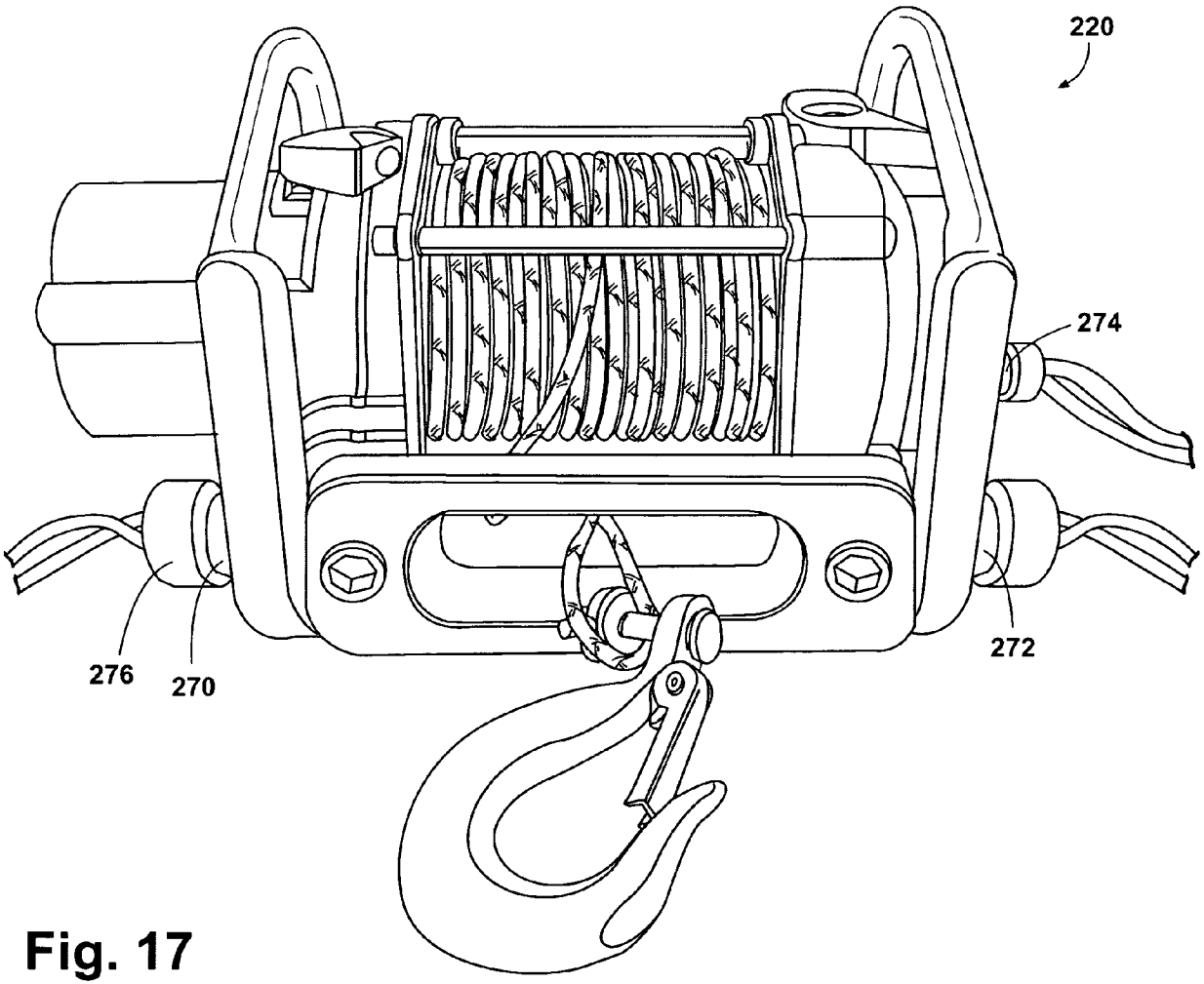
FIG. 17 is a front perspective view of a portable winch assembly identifying multiple supply power adapter locations.

Referring to FIG. 17, in order to maximize accessibility and use of portable winch assembly 220, multiple locations for connection of a power cable can be provided. For example, each of a first, second, and third power cable connectors 270, 272, 274 can be provided in various locations about the frame of portable winch assembly 220. Each of the cable connectors 270, 272, 274 can receive a power cable fitting 276 permitting electrical power to be fed to the portable winch assembly from either of opposite sides or from different corner locations of the frame. This permits the portable winch assembly to be located in multiple orientations having different portions of the structure in close proximity to objects such as a wall or corner without interference with the power cable caused by the connection location of the electrical power cable.

Figure 18:
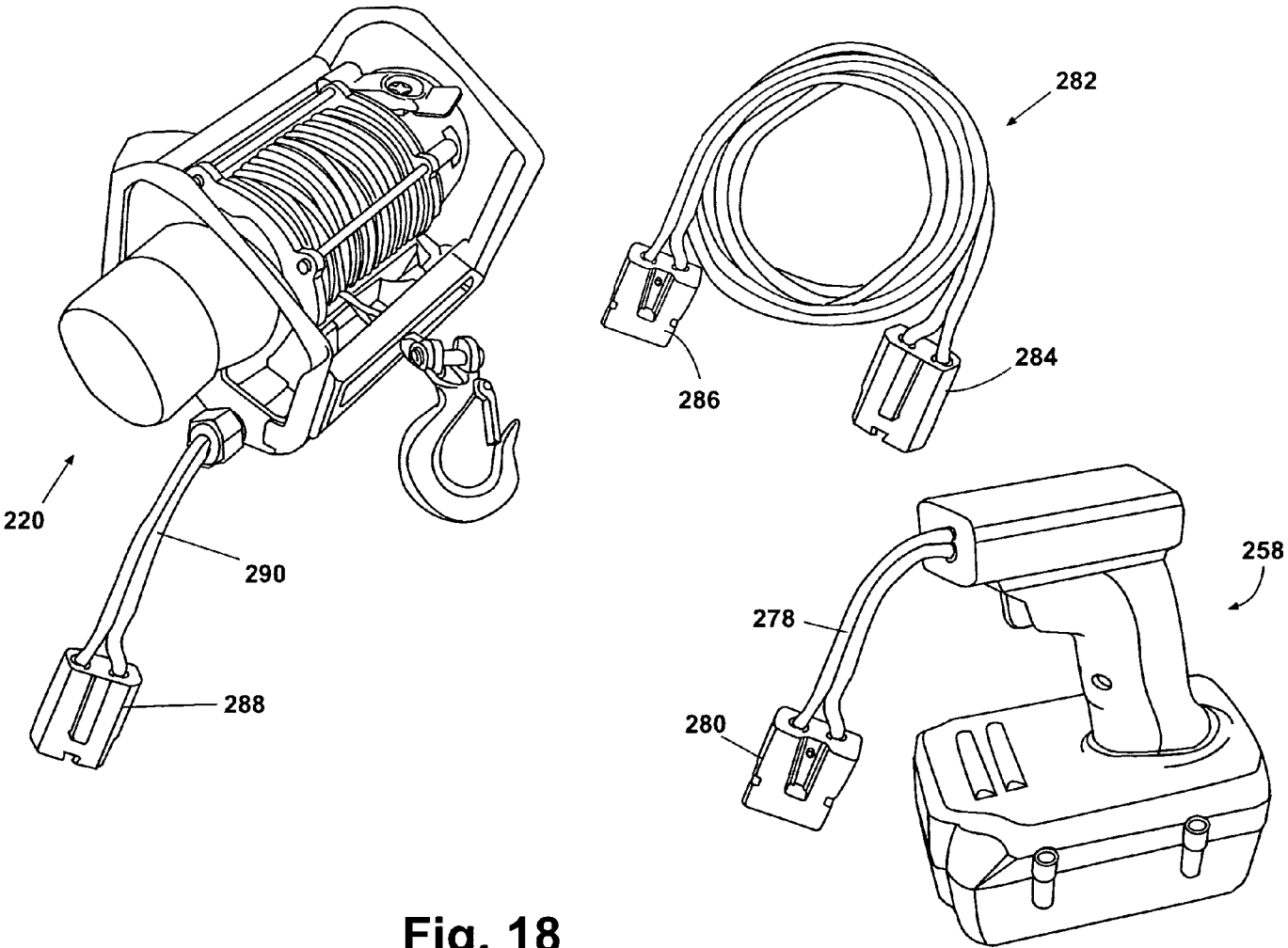
FIG. 18 is a front perspective view of a hand held remote control unit adapted for use with an extension power cable.

Referring to FIG. 18, when a hand-held remote control unit is provided for electrical power to the portable winch assembly, it is anticipated that either a limited amount of power cable be provided to minimize the chance of damaging the power cable, or that a maximum amount of power cable be provided for those instances when the portable winch assembly is located at a maximum distance from the operator. To accommodate these different conditions, and using the hand-held remote control unit 258 as an example, a reduced length power output cable 278 can be connected to the hand-held remote control unit with a spade connector 280 provided at an end thereof. The reduced length is not a fixed value, and can range from about 6 inches (15.2 cm) to approximately 3 feet (0.9 m). An extension power cable 282 is then used to connect the hand-held remote control unit to the portable winch assembly 220. Extension power cable 282 can therefore provide cable in a variety of predetermined lengths which are selectable by the user. A first connector 284 is provided to connect to spade connector 280 and a second connector 286 is provided at an opposite end of extension power cable 282 to connect to a winch assembly power connector 288. A winch assembly power cable 290 having a length similar to the reduced length power output cable 278 connects directly to portable winch assembly 220. It is also anticipated that more than one extension power cable 282 can also be used. A maximum length of extension power cable is determined by the power output of the battery unit of the hand-held remote control unit.

Figure 19:
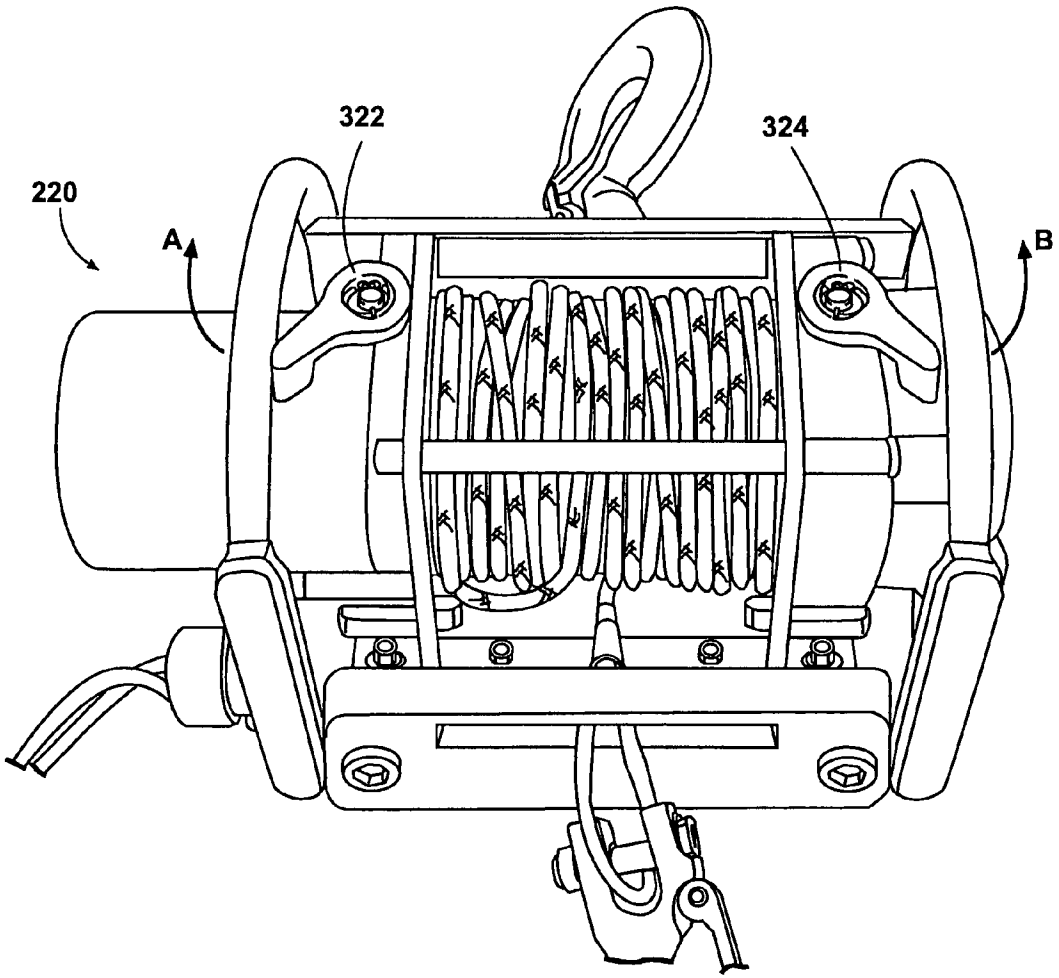
FIG. 19 is a front perspective view of a portable winch assembly having dual spool locks.
Figure 20:
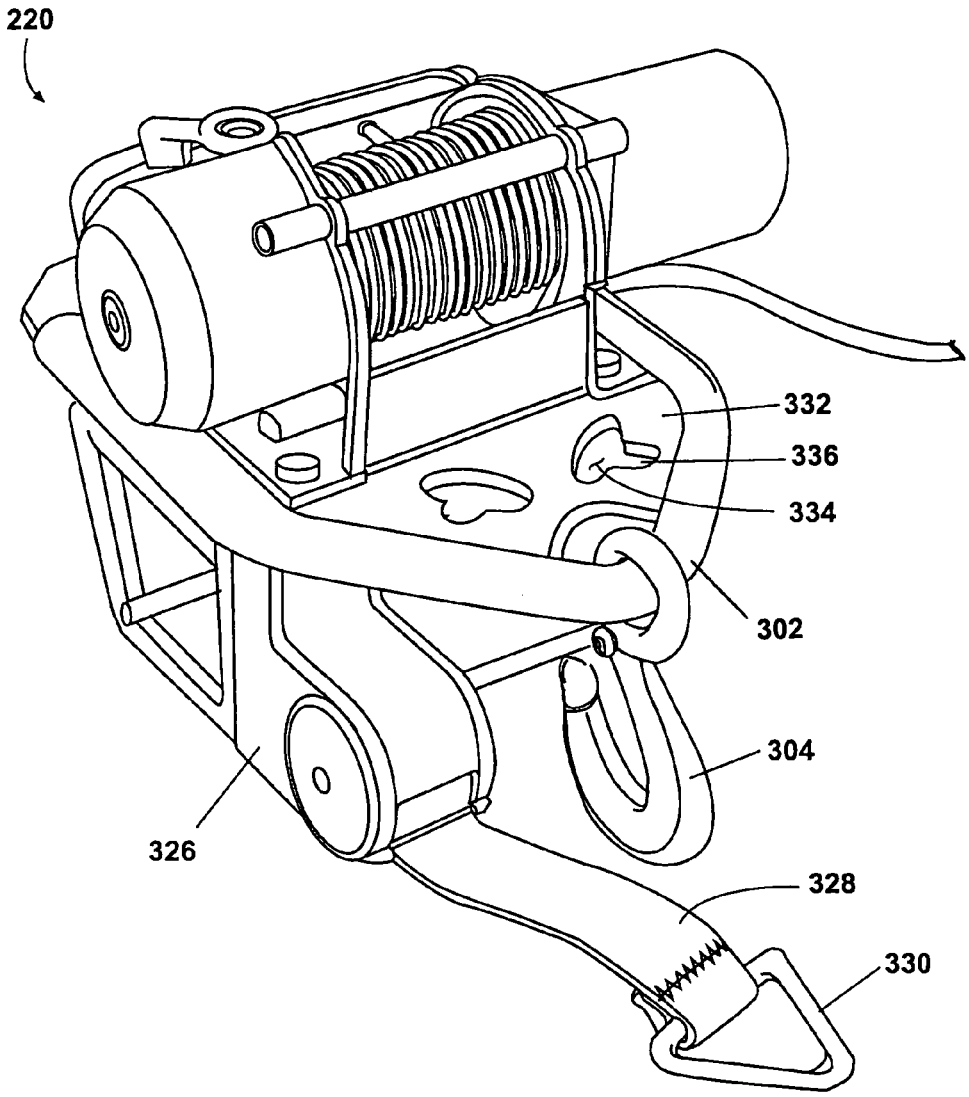
FIG. 20 is front elevational view of a portable winch assembly having a retractable strap assembly and chain adapter plate fixed to the winch frame.

Referring to FIGS. 19 and 20, additional features can be added to a portable winch assembly of the present disclosure. According to several embodiments, a track connector plate 292 can be fixed to an under side of the frame for portable winch assembly 220. Track connector plate 294 can provide an adaptor known in the art such as an E-Track connector adapted to receive a track connector coupling 293. Track connector coupling 293 is a releasable coupling which can be added to the configuration to extend a flexible strap 294 having a coupling adaptor 295 at an end thereof to increase the flexibility for temporarily mounting the portable winch assembly 220.

Figure 21:
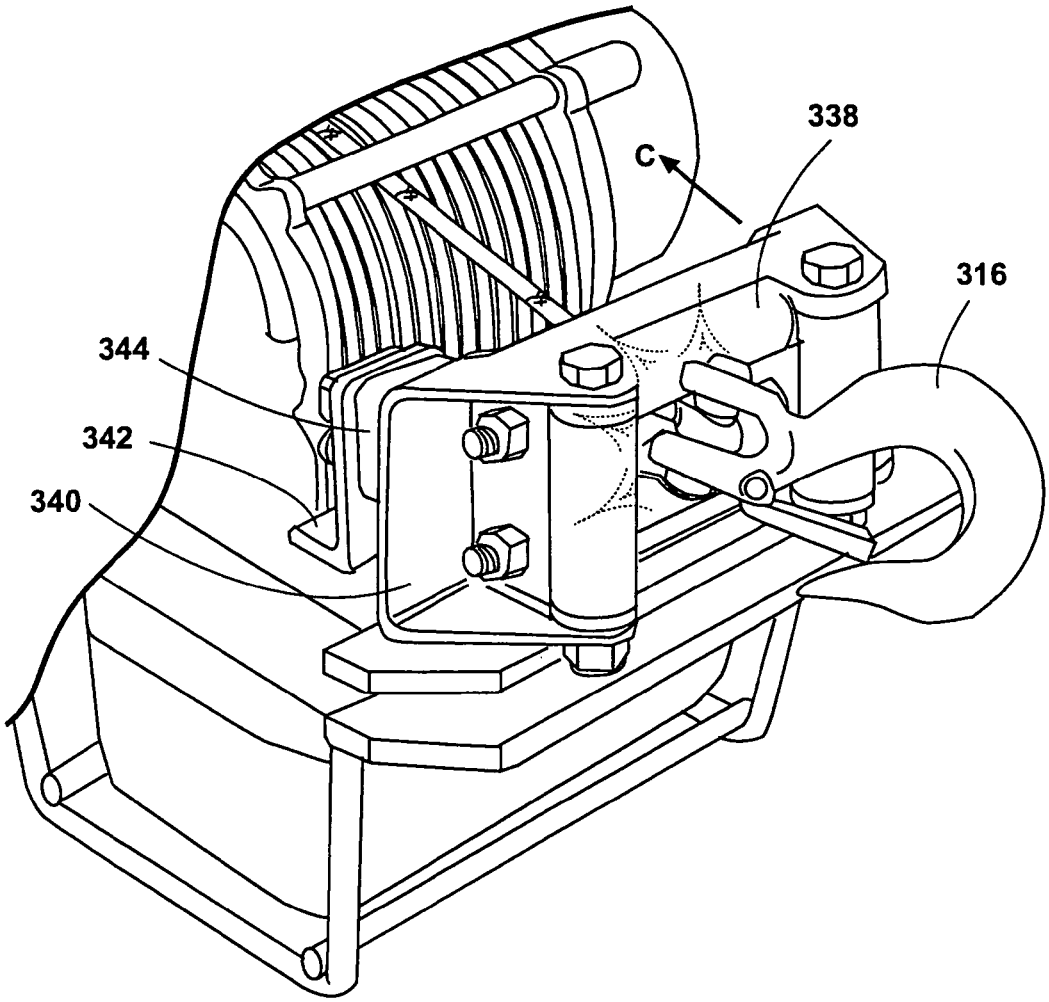
FIG. 21 is front elevational view of a portable winch assembly adapted to include a reel stop switch.

Referring to FIG. 21, portable winch assembly 220 can be used as a direct hoist device based on the configuration of a frame base 296. Frame base 296 provides a first frame member 298 and a second frame member 300 which together define a substantially triangular shaped frame having a frame apex 302. A lift connector 304 such as a hook can be connected to frame apex 302. Connector 304 can be connected to frame apex 302 abutting a first end 305 of a divider 306. Divider 306 is fixedly connected to frame apex 302. With lift connector 304 positioned as shown a cable 308 extending from a spool 310 of portable winch assembly 220 aligns with lift connector 304 defining an first axis of force 312 for a lift operation.

Figure 22:
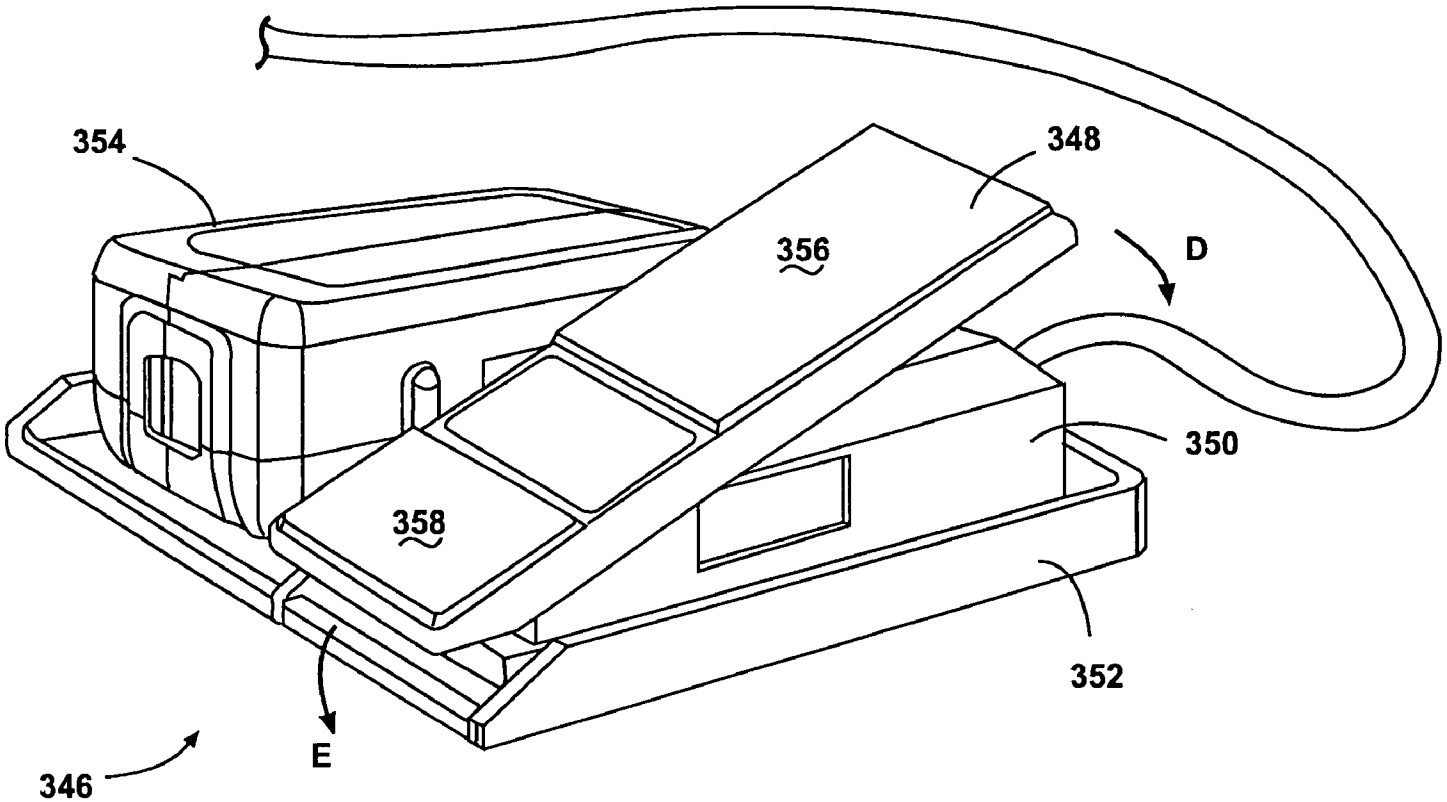
FIG. 22 is a side elevational view of a foot operated remote control unit having a releasable, rechargeable battery pack.

Referring to FIG. 22, the same configuration of frame base 296 also provides for a snatch block operation of portable winch assembly 220. This is accomplished by positioning the lift connector 304 at an opposite second end 314 of the divider 306. A second lift connector 316 which can also be a hook connected to a free end of cable 308 is releasably connected to a post 318 provided with the frame of portable winch assembly 220. This configuration of the lift connector 304 and the cable 308 defines a second axis of force 320 for a snatch operation permitting further connection of a snatch block (not shown) which can be used to increase the load lifting capability of portable winch assembly 220.

Referring to FIG. 19, portable winch assembly 220 can be provided with a double latching mechanism for redundancy to prevent free spooling of the cable from the cable spool. Both a first and second latch arm 322, 324 are oriented at opposite ends of the spool 246. First latch arm 322 is latched by rotation about a latching arc of rotation "A" to prevent rotation of spool 246, and second latch arm 324 is latched by rotation about an opposite latching arc of rotation "B" to provide a redundant latching force. The use of the two first and second latch arms 322, 324 which latch by rotation in opposite directions provides redundancy in the event that one of the latch arms is inadvertently released during operation of the portable winch assembly. This ensures that at least one of the latch arms 322, 324 will remain in the latched position to prevent free spooling of the cable.

Referring to FIG. 20, according to additional embodiments of the present disclosure a lift connector 304 such as a hook can be connected to a frame apex 302 and a retractable strap housing 326 can be fixedly connected to the winch support frame 236. Retractable strap housing 326 provides for the manual extension and biased automatic retraction of a strap 328 having a coupling adapter 330 or similar adapter provided at a free end of the strap 328. Use of retractable strap housing 326 and strap 328 provides a greater range of location for portable winch assembly 220 or connection to a larger item such as the trunk of a tree, a small structure, or the like. An adapter plate 332 can also be fixedly connected to winch support frame 236. Adapter plate 332 can include one or more clearance apertures 334 having a chain link engagement slot 336 proximate thereto. Clearance aperture 334 and link engagement slot 336 are each adapted to receive a linked chain and engage one of the links of the chain (not shown) by rotation and insertion into link engagement slot 336. A chain can be used in place of or in addition to the retractable strap housing 326 with strap 328.

Referring to FIG. 21, as cable 308 is wound onto spool 246 a second lift connector 316 can contact one or more cable rollers 338. Once contact with the cable rollers 338 occurs, further application of power to the portable winch assembly can result in an over-torque condition of the motor. To reduce the possibility of an over-torque condition occurring, a switch or sensor can be used which actuates when second lift connector 316 contacts the one or more cable rollers 338. In one exemplary embodiment, cable rollers 338 are connected to a frame mounted bracket 340, and a second bracket 342 is fixedly connected to proximate structure of the winch support frame 240. A contact switch 344 mounted to either of frame mounted bracket 340 or second bracket 343 is positioned between the frame mounted bracket 340 and second bracket 342 so that deflection of frame mounted bracket 340 caused by contact with second lift connector 316 closes the contact switch 344 and isolates electrical power from the winch motor. It should be evident that other types of switches including pressure switches, and sensors such as location and torque sensors can be used in place of contact switch 344 within the scope of the present disclosure.

Referring to FIG. 22, a foot operated remote control unit 346 can be used in place of any one of the hand-held remote control units previously described herein. Foot operated remote control unit 346 can include a foot pedal 348 which is rotatably connected to a control box 350. Foot pedal 348 is biased to return to the null or off position shown using a biasing device such as a torsion spring known in the art. The control box 350 is mounted to a base 352 which is also adapted to receive a battery pack 354 similar to the removable rechargeable battery packs previously discussed herein used in any of the previously described hand-held remote control units. Foot petal 348 remotely controls operation of the portable winch assembly 220 (not shown in this view) by applying pressure to a toe pad 356 to rotate the toe pad 356 in a direction of rotation "D". This motion can be converted to an electrical current via controls (not shown) located in control box 350 to either extend or retract a cable from or into the portable winch assembly. An opposite operation of the portable winch assembly can also be provided by applying pressure to a heel pad 358 positioned at an opposite end of foot pedal 348 in a direction of rotation "E". It should also be evident that the operations can be reversed from those described within the scope of the present disclosure. Use of the foot operated remote control unit 346 provides a hands-free operation of the portable winch assembly 220 to allow the operator to perform other activities during operation. A relative displacement of foot pedal 348 can also be converted using associated controls provided in control box 350 to control an operating speed of portable winch assembly 220.

Referring again to FIGS. 6, 7, and 8, the battery pack 204 can be interchangeably and releasably connected to any of the remote control units 200, 212, or 218, or any of the other remote control units disclosed herein using snap-in or similar connections commonly used for portable electric drills and the like. Electrical power from the battery pack 204 is used to operate the portable winch assembly 220. Controls are therefore provided in either the remote control unit(s) or the portable winch assembly 220 to control electrical power for operation of the portable winch assembly 220 to either extend or retract the lift wire (control direction of rotation of the motor), to energize other features such as the light on the portable winch assembly 220, or to provide for sensed conditions such as motor torque, battery charge, and the like. Cabling for the remote control units can therefore provide for the individual function of power transfer from the battery pack 204 to the winch motor, or can also provide for the additional operating features including communication between the remote control unit and the portable winch assembly 220. Multiple wires including wires of varying gauge can therefore be used in the connecting cables to provide the multiple functions. Printed circuit boards or chips can therefore be provided in either or both the remote control unit and the portable winch assembly 220.

A portable winch assembly of the present disclosure offers several advantages. By connecting a winch assembly to a manually portable frame and providing for the use of a removable rechargeable battery pack, the operator has the flexibility of removing the battery pack and recharging or replacing the battery pack with a recharged unit while the winch assembly is positioned for use. Also, by repositioning a rechargeable battery pack to a hand or foot controlled remote control unit, the weight of the battery pack is removed from the winch assembly and the operator has easier access to the removable battery pack if replacement and/or recharging of the battery units is required during operation.

The use of standardized replaceable rechargeable battery packs also provides the option to the operator of using battery packs which are also adapted for use in other tools such as but not limited to drills, saws, and the like. This provides improved flexibility for operation of the portable winch assemblies of the present disclosure and use of the battery packs for multiple applications, in addition to providing power to the portable winch assemblies of the present disclosure. In several embodiments, by removing the power source (battery pack) from the structural support unit of the portable winch assembly and placing the battery pack in a hand or foot operated remote control unit the weight and required structure of the frame supporting the portable winch assembly is reduced making the unit more portable and locating the battery pack where the operator can easily remove the battery pack for recharging. Multiple options for a hand or foot operated remote control unit of the present disclosure are also provided such as a an ergonomically designed handle, use of multiple types of switches adapted for operation of the winch assembly, ease of replacement and engagement of the battery pack into the unit, and the capability of providing a user selectable length of cabling for operation of the portable winch assembly by the operator.

Figure 5:
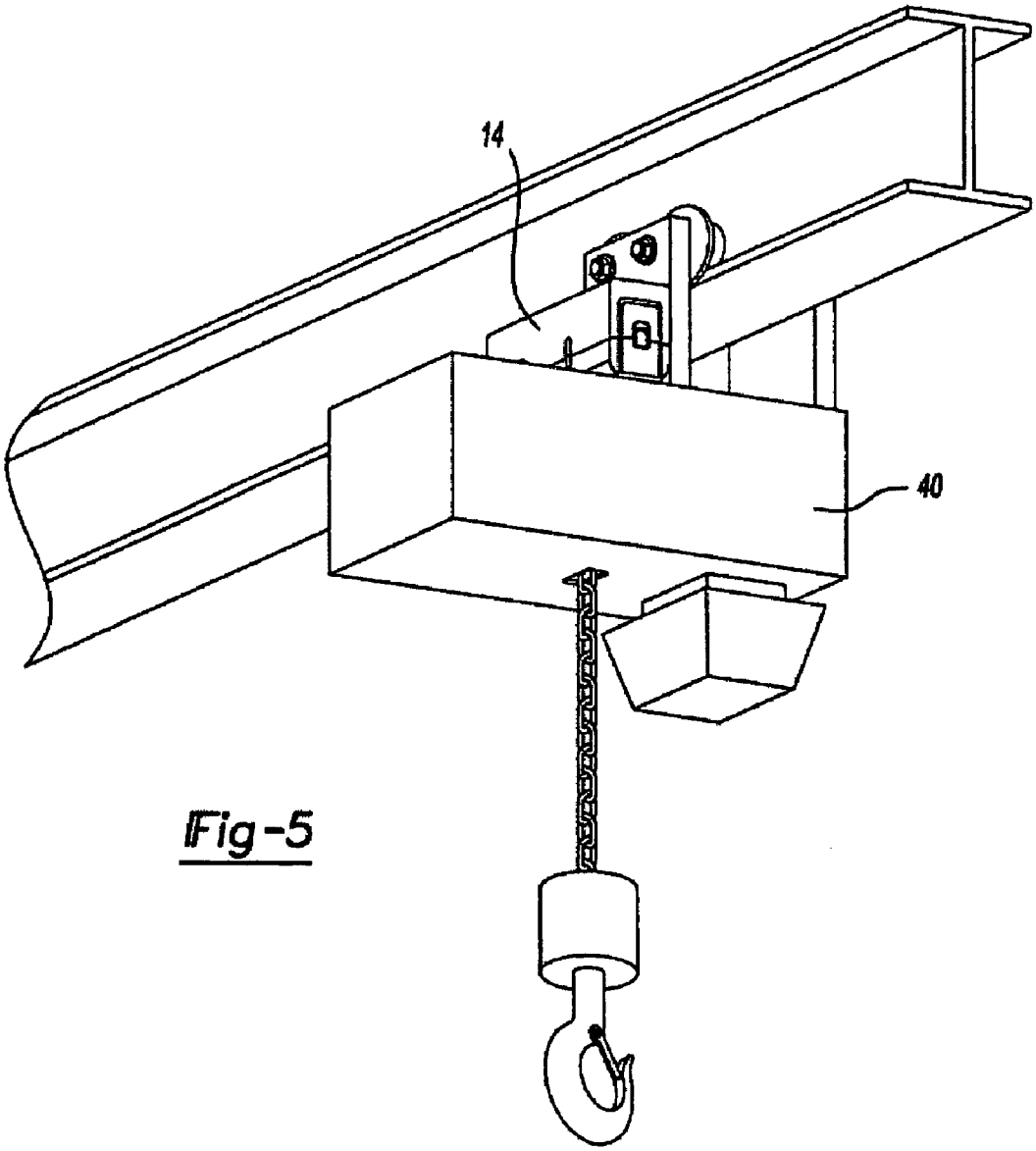
FIG. 5 is a perspective view of an exemplary chain hoist assembly having a removable and rechargeable battery pack.

While the above description is provided with reference to a winch mechanism, the broader aspects of this disclosure are applicable to other hoisting applications. For instance, a removable and rechargeable battery pack 14 may be integrated with a motor driven chain hoist 40 as shown in FIG. 5. It is envisioned that the use of a removable and rechargeable battery pack may also be extended to other types of hoisting applications. The above description is merely exemplary in nature and is not intended to limit the present disclosure, application, or uses.

What is claimed is:

1. A portable winch assembly, comprising:

a winch mechanism; and a battery pack housing a plurality of battery cells, the battery pack being releasably coupled to a hand held remote control unit, the remote control unit together with the battery pack remotely located from and freely movable with respect to the winch mechanism and electrically coupled to the winch mechanism by a flexible power cable, the remote control unit operating to transfer electrical power from the battery pack to power the winch mechanism.

2. The portable winch assembly of claim 1, further comprising a support structure adapted to support the winch mechanism and having a handle adapted to permit manual transfer of the support structure and winch mechanism.

3. The portable winch assembly of claim 2, wherein the support structure includes a triangular-shaped frame having a frame apex adapted to receive a lift connector.

4. The portable winch assembly of claim 1, wherein the remote control unit includes a digital readout adapted to present a torque output of the winch mechanism.

5. The portable winch assembly of claim 1, wherein the remote control unit includes a first switch to control a velocity of the winch mechanism and a second switch to control a direction of operation of the winch mechanism.

6. The portable winch assembly of claim 1, wherein the remote control unit includes a frame releasably receiving the battery pack.

7. A portable winch assembly, comprising:

a winch mechanism connected to a support structure adapted to be manually transportable; and a battery pack housing a plurality of battery cells, the battery pack being releasably coupled to a hand held remote control unit freely positioned away from the support structure and operated to control the winch mechanism, the battery pack and the remote control unit electrically connected to the winch mechanism by a flexible power cable such that electrical power from the battery pack is transferred through the remote control unit via the power cable to power the winch mechanism.

8. The portable winch assembly of claim 7, wherein the remote control unit is a hand-held unit having at least one indicator providing visual indication of a charge strength of the battery pack.

9. The portable winch assembly of claim 7, further comprising:

a spool having a wire rotatably wound thereon; and a light connected to the winch assembly and operable by the battery pack to illuminate at least the spool.

10. The portable winch assembly of claim 9, wherein the remote control unit includes a switch operable to control the light.

11. A portable winch assembly, comprising:

a winch mechanism connected to a support structure adapted to be manually transportable;

a battery pack housing a plurality of battery cells, the battery pack being releasably coupled to a hand held remote control unit operated to control the winch mechanism, the remote control unit together with the battery pack remotely located from and movable with respect to the winch mechanism and electrically coupled to the winch mechanism by a flexible power cable; and a retractable strap housing connected to the support structure including a flexible strap manually extendable from the strap housing and automatically retractable into the housing.

12. The portable winch assembly of claim 11, further comprising a coupling adapter connected at a free end of the flexible strap.

13. The portable winch assembly of claim 11, further comprising an adapter plate connected to the support structure, the adapter plate having each of a chain clearance aperture and a chain link engagement slot.

14. A portable winch assembly, comprising:

a winch mechanism connected to a support structure adapted to be manually transportable, the winch mechanism including:

a spool having a wire releasably wound thereon; and a lift connector attached to a free end of the wire;

a battery pack remote from and free movable with respect to the winch mechanism and connected to the winch mechanism by a flexible cable to provide electrical power to the winch mechanism to rotate the spool to release or retract the wire; and a device connected to the support structure operable to electrically isolate the winch mechanism when the lift connector contacts the support structure.

15. The portable winch assembly of claim 14, wherein the device comprises a contact switch.

16. The portable winch assembly of claim 14, wherein the device comprises a sensor.

17. The portable winch assembly of claim 14, further comprising a remote control unit adapted to releasably receive the battery pack and to remotely control operation of the winch mechanism via transfer of battery power through the flexible cable to the winch mechanism, the battery pack housing a plurality of battery cells.

18. The portable winch assembly of claim 17, wherein the flexible power cord is connected to the remote control unit and releasably connected to one of a plurality of power cable connectors individually located on the support structure.

19. A method for controlling a portable winch mechanism having a support structure using a battery pack housing a plurality of battery cells and a remote control unit, comprising:

releasably coupling the battery pack to the remote control unit such that the remote control unit and battery pack allow for hand held movement independent of the support structure;

electrically connecting the battery pack and the remote control unit to the winch mechanism using a flexible power cable; and operating at least one control element of the remote control unit to operate the winch mechanism.

20. The method of claim 19, further comprising connecting the winch mechanism to the structure.

21. The method of claim 19, further comprising configuring the support structure to provide a handle adapted for manual transport of the winch mechanism.

22. The method of claim 19, further comprising:

providing power to a winch motor using a battery electronic control unit outputting a plurality of pulse width modulation control signals to drive a driver circuit; and shifting a pulse width modulation output of the driver circuit to drive a gate of a discharge FET to cycle the discharge FET on and off depending on sensed conditions.

23. The method of claim 19, further comprising providing a battery electronic control unit for protection of individual cells of the battery pack.

24. A portable winch assembly, comprising:

a winch mechanism; and a battery pack housing a plurality of battery cells, the battery pack being releasably coupled to a foot controlled remote control unit, the remote control unit together with the battery pack remotely located from and freely movable with respect to the winch mechanism and electrically coupled to the winch mechanism by a power cable, the remote control unit operating to transfer electrical power from the battery pack to power the winch mechanism; and the remote control unit having a foot pedal adapted to control infeed and outfeed operations of the winch mechanism by opposite rotation of the foot pedal.

* * * * *